US011179838B2

(12) United States Patent
Yeung

(10) Patent No.: US 11,179,838 B2
(45) Date of Patent: Nov. 23, 2021

(54) PARALLEL JAWS LOCKING WRENCH/PLIER

(71) Applicant: Kin-Wai Yeung, Sugar Land, TX (US)

(72) Inventor: Kin-Wai Yeung, Sugar Land, TX (US)

( * ) Notice: Subject to any disclaimer, the term of this patent is extended or adjusted under 35 U.S.C. 154(b) by 0 days.

(21) Appl. No.: 16/802,550

(22) Filed: Feb. 26, 2020

(65) Prior Publication Data

US 2021/0260743 A1 Aug. 26, 2021

(51) Int. Cl.
*B25F 1/00* (2006.01)
*B25F 1/04* (2006.01)

(52) U.S. Cl.
CPC ..... *B25F 1/003* (2013.01); *B25F 1/04* (2013.01)

(58) Field of Classification Search
None
See application file for complete search history.

(56) References Cited

U.S. PATENT DOCUMENTS

| | | | | | |
|---|---|---|---|---|---|
| 1,086,078 | A | | 2/1914 | Palmer | |
| 2,399,454 | A | | 4/1946 | Snell | |
| 2,417,013 | A | * | 3/1947 | Petersen | B25B 7/123 81/356 |
| 2,481,866 | A | | 9/1949 | Petersen | |
| 2,489,895 | A | * | 11/1949 | Kash | B25B 7/123 81/370 |
| 2,519,630 | A | | 8/1950 | Boyer | |
| 2,553,400 | A | | 5/1951 | Blair | |
| 2,679,779 | A | | 11/1951 | Spikings | |
| 2,618,188 | A | * | 11/1952 | Emmett | B25B 7/02 81/356 |
| 3,195,382 | A | | 7/1965 | Rommel et al. | |
| 3,608,405 | A | * | 9/1971 | Schmidt | B25B 7/123 81/356 |
| 4,094,215 | A | | 6/1978 | Hudson | |
| D358,746 | S | | 5/1995 | Neff | |
| 5,644,960 | A | * | 7/1997 | O'Brien | B25B 7/123 81/363 |
| 2011/0107880 | A1 | | 5/2011 | Stucky | |

FOREIGN PATENT DOCUMENTS

| | | |
|---|---|---|
| GB | 1330492 | 4/1979 |
| WO | WO 2019012273 | 1/2019 |

* cited by examiner

*Primary Examiner* — Brian D Keller

(57) ABSTRACT

An improved parallel-jaws locking wrench/plier with toggle action includes a body element, a fixed jaw, and a moving jaw capable of moving rectilinearly by means of an action cam, which is pivotally connected to a locking lever coupling respectively to the upper ends of a fulcrum bar and a releasing lever thereof. A handle secured to the body element has an axially adjustable element to regulate the opening of the jaws. Close to the pivot of the releasing lever are two outstanding members disposed respectively opposite sides thereof. Gripping the locking lever towards the handle till being stopped by the two outstanding members hitting said handle will toggle continuous gripping/clamping action on a workpiece. Gripping the releasing lever towards the handle will render the two outstanding members to serve as fulcrums, providing the former with leverage to force the toggle linkage back to its relaxing condition to release the workpiece. The releasing action requires only one hand.

2 Claims, 14 Drawing Sheets

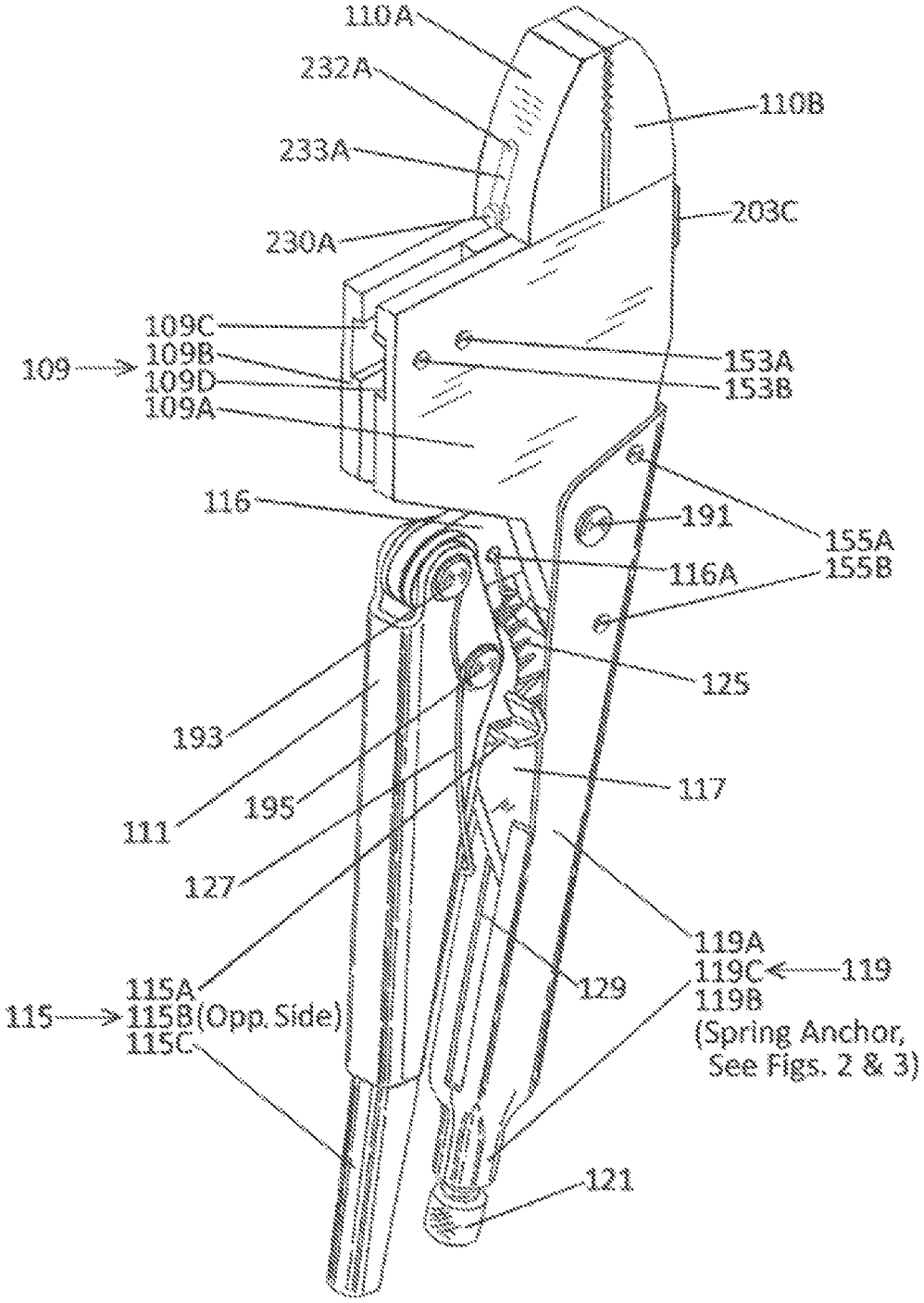
FIG. 1-A

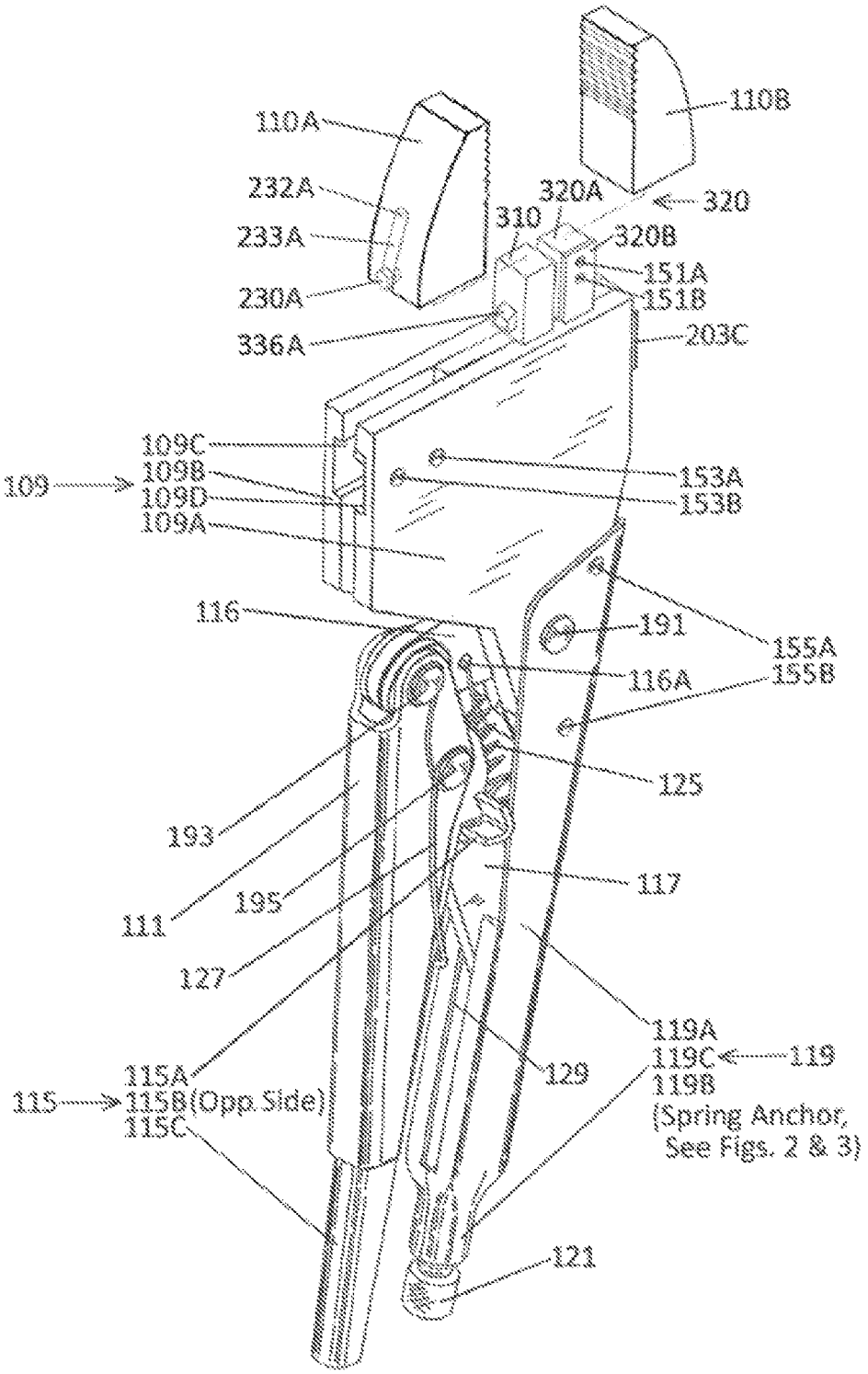
FIG. 1-B

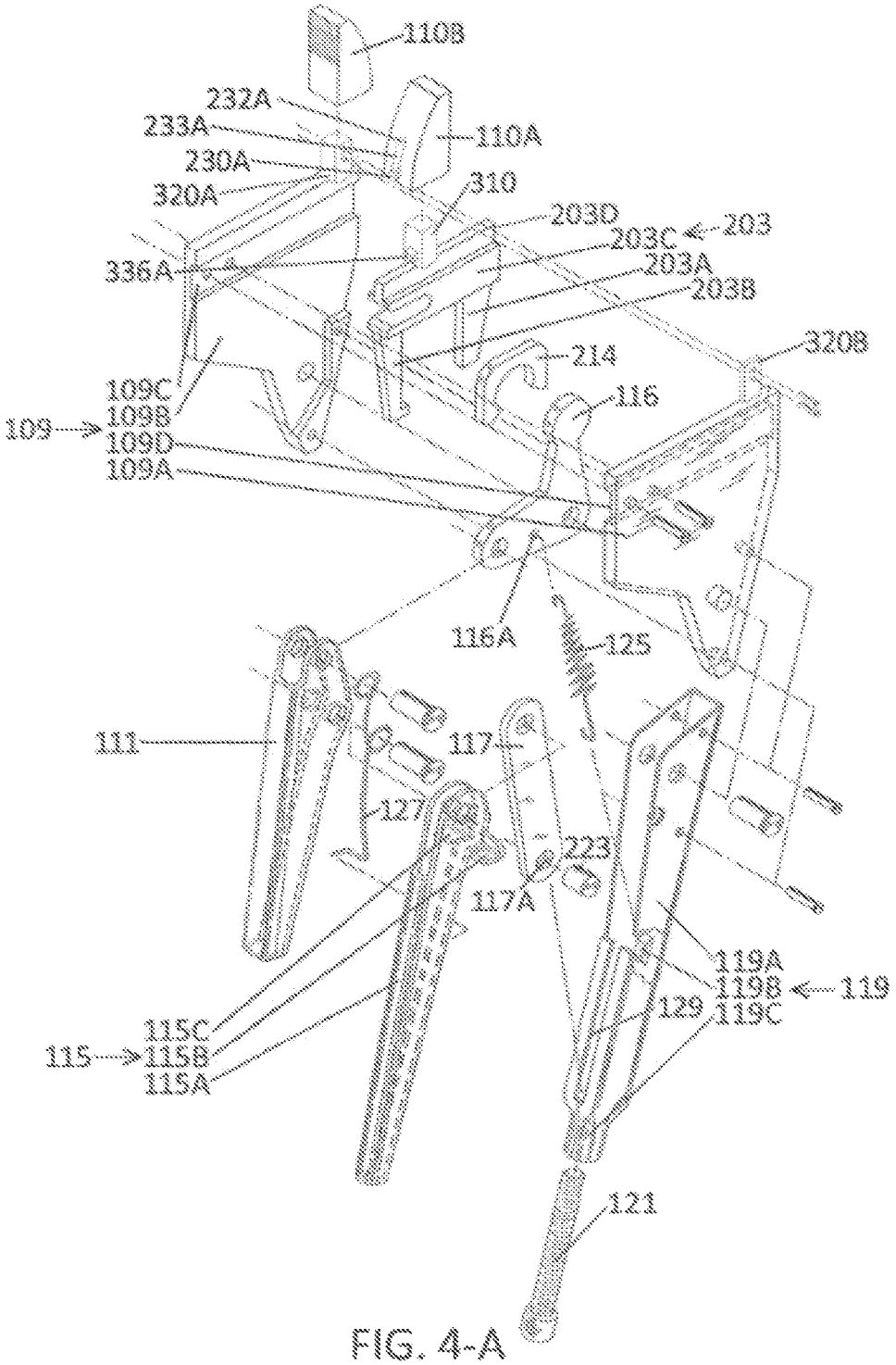
FIG. 4-A

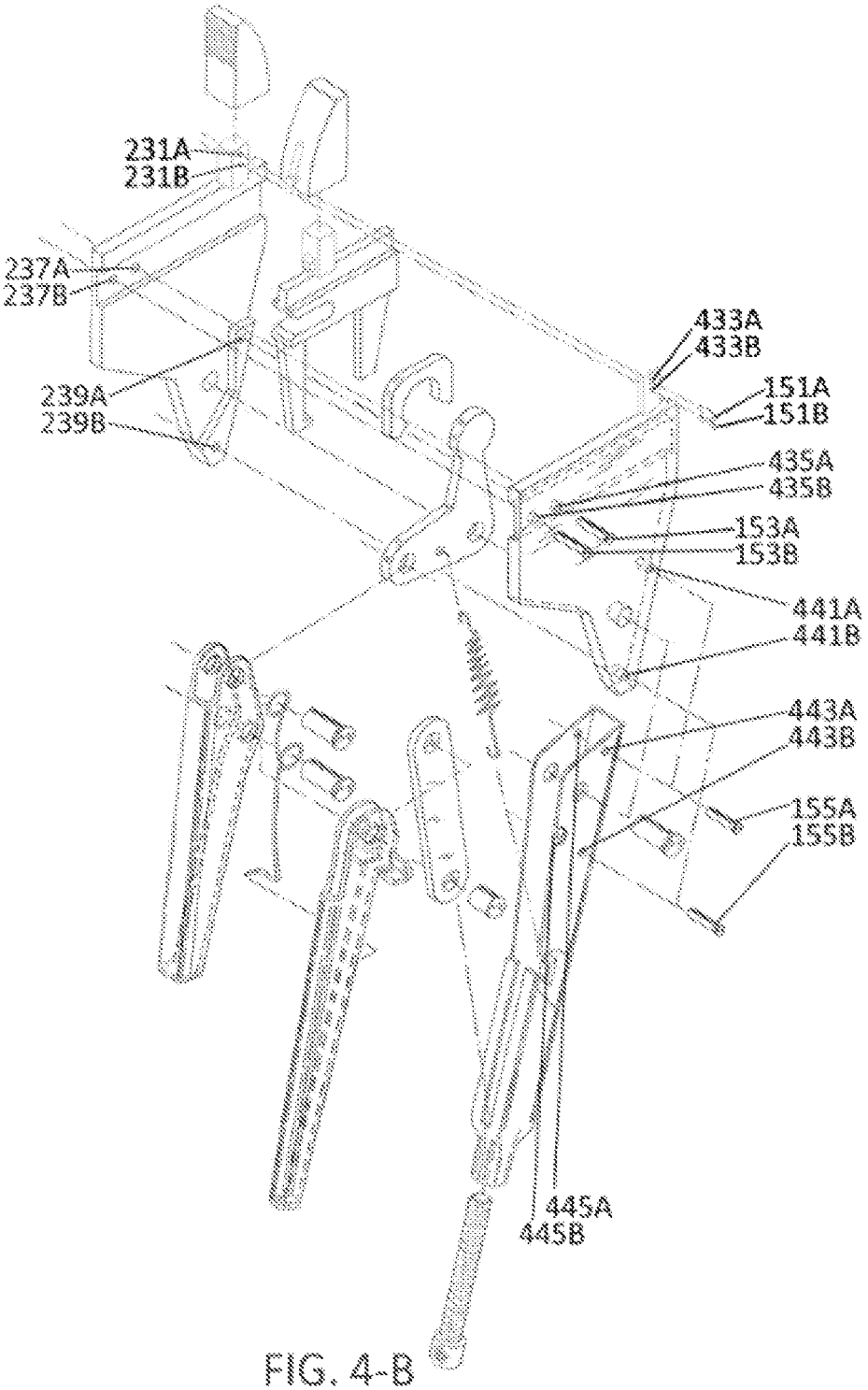
FIG. 4-B

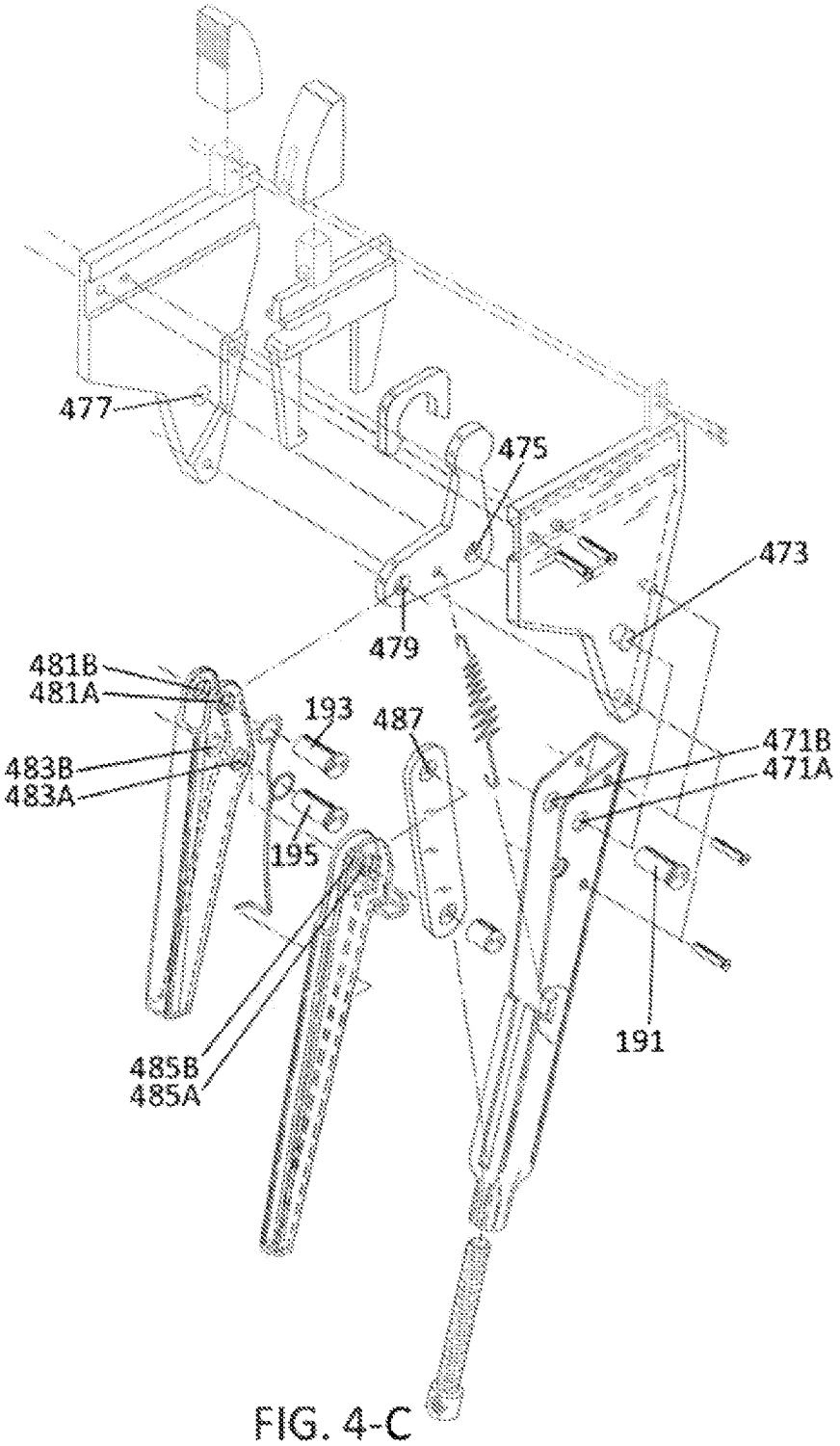
FIG. 4-C

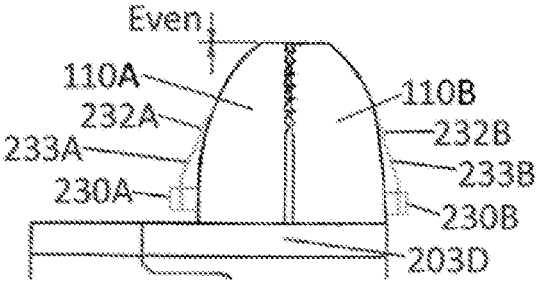
FIG. 7-A1
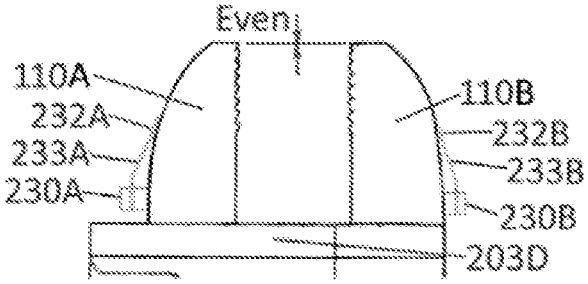
FIG. 7-A2
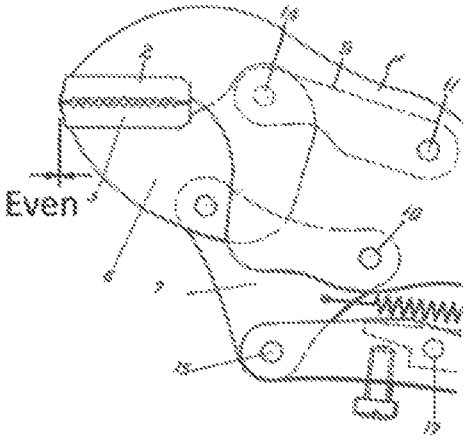
FIG. 7-B1
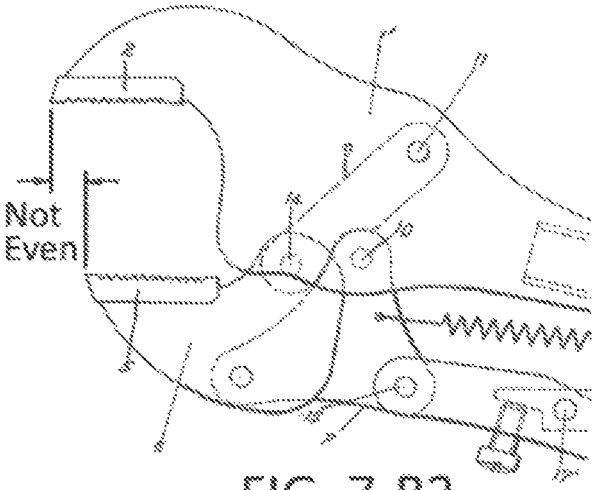
FIG. 7-B2
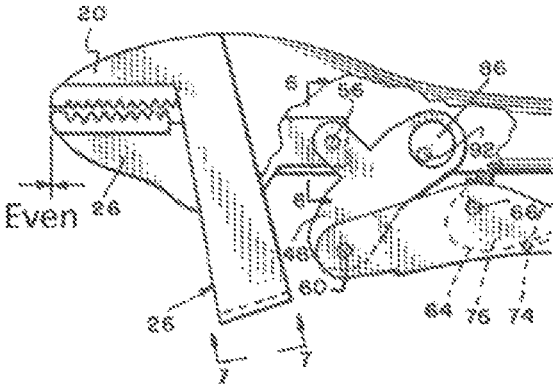
FIG. 7-C1
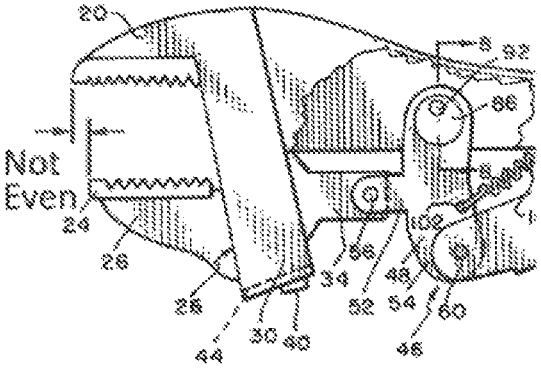
FIG. 7-C2
FIG. 7

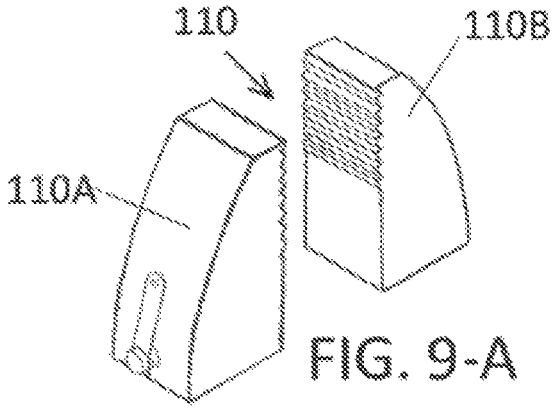
FIG. 9-A
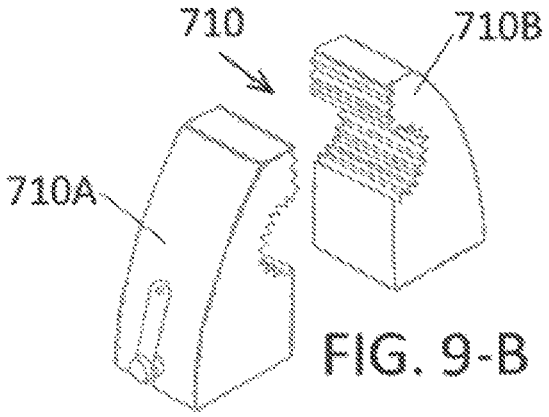
FIG. 9-B
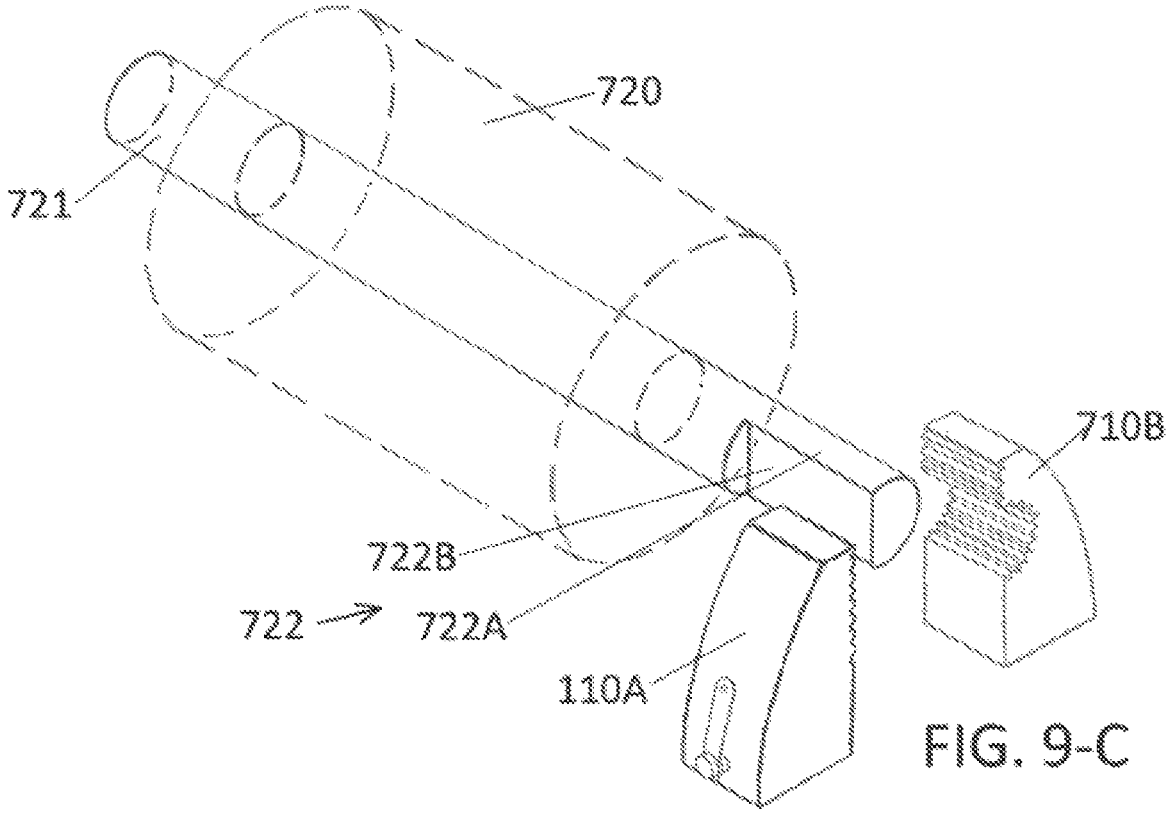
FIG. 9-C
FIG. 9

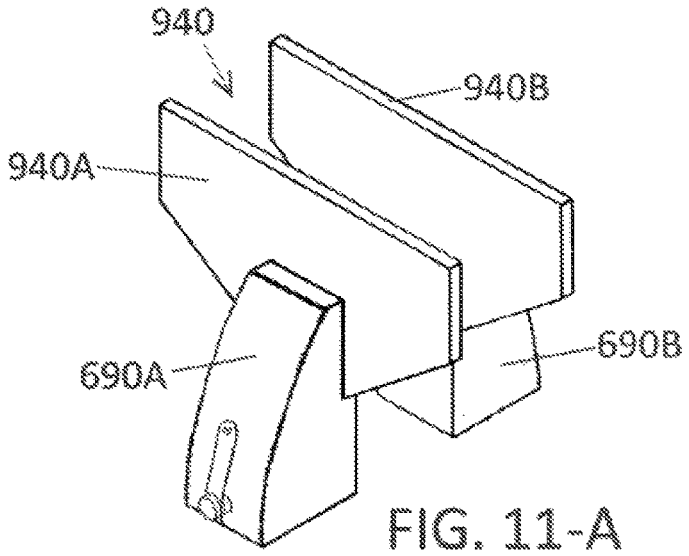
FIG. 11-A
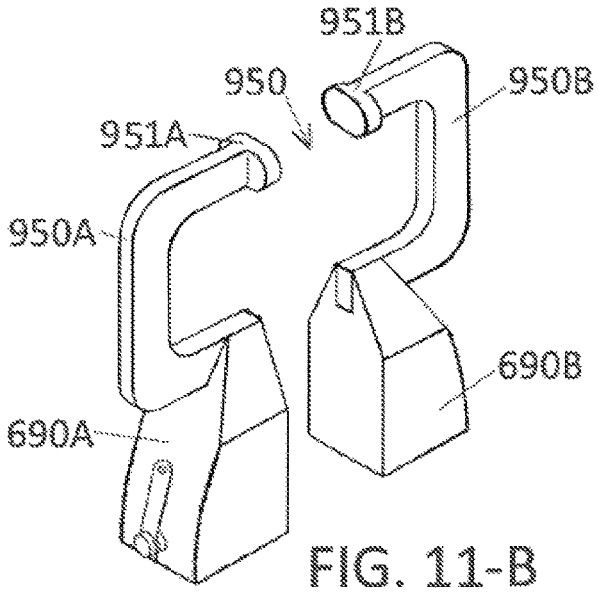
FIG. 11-B
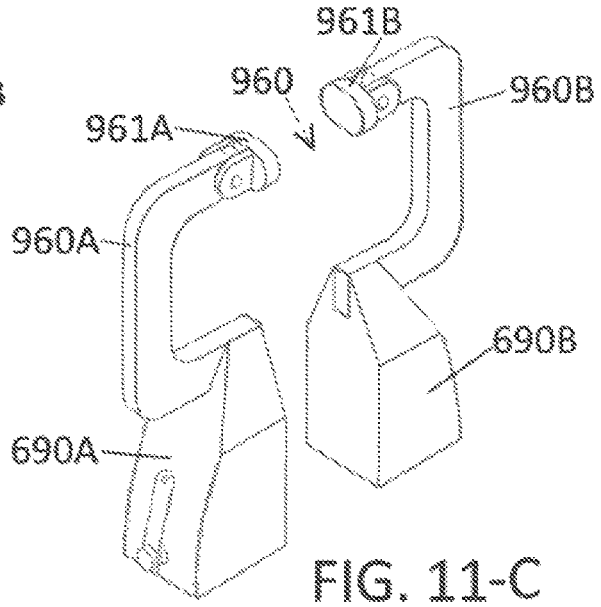
FIG. 11-C
FIG. 11

PARALLEL JAWS LOCKING WRENCH/PLIER

This application claims the benefit of provisional patent application Ser. No. 62/811,542, filed 2019 Feb. 28 by the present inventor.

BACKGROUND

Prior Art

This invention relates to the type of parallel jaws locking wrench/plier which can be used for one function or the other. The parallel-jaws feature provides a positive clamping/gripping on workpieces that have opposite parallel faces such as hex nuts or bolt heads. Furthermore, its other desirable attribute is the locking ability that helps the user to save the operating hand effort when a duration of tight clamping/gripping onto the workpiece is required.

In general, parallel-jaws is a desirable feature to associate with locking wrench/plier. However, the designs of this feature shown in prior-arts are questionable or not practical, or even not desirable, from the sturdiness standpoint.

One arrangement chosen by prior-arts to achieve the parallel jaws configuration is the parallelogram arrangement. This concept can be found dated back to 1914 in U.S. Pat. No. 1,068,078 issued to Palmer. Later prior-arts using the same concept include 1951 U.S. Pat. No. 2,679,779 to Spikings, 1965 U.S. Pat. No. 3,195,382 to Rommel et al, and 2011 U.S. patent 2011/0,107,880 to Stucky, just to name a few. This arrangement has the drawback that the tips of the two parallel jaws cannot line up evenly throughout the entire range of the jaw opening, i.e., the tips of the two jaws line up evenly only when the two jaws are entirely closed. When the jaws are opened, the moving jaw carried by the swinging motion of the parallelogram will have its tip behind that of the fixed jaw, especially when the two jaws are widely opened at their maximum range. For some application, this drawback is not desirable, because such an uneven-tip situation can cause insecure gripping/clamping. Another drawback of the parallelogram is the side play of the moving jaw caused by the inherent pivotal clearance. This drawback can cause undesirable result when critical clamping alignment is required. There are other kinds of parallel-jaws concept chosen by other prior-arts, and their inherent shortcomings are explained in the following.

Snell, in U.S. Pat. No. 2,399,454 (1946), shows a parallel jaws wrench. This embodiment has its moving jaw directly hinged to the adjustment screw. When the moving jaw is pressing on the workpiece with toggle action, the user would have difficulty to loosen the adjustment screw with bare hand in order to release the jaws to let free the tightly gripped/clamped workpiece. An alternative way to release the workpiece is by pulling the locking lever away from the handle. But again this is not easy or convenient when the workpiece is under tight toggle gripping. It has another drawback. As mentioned above, the moving jaw is pivotally hinged at the end of the adjustment screw. Therefore, in reality the moving jaw can have parallelism with the fixed jaw only before the toggle force is applied. Once the toggle force is applied, the moving jaw will tend to rotate with respect to the pivotal hinge, and the force gripping/clamping on the workpiece will be mainly applied by the tip of the moving jaw and is not evenly distributed on the working areas of the jaws.

Petersen, in U.S. Pat. No. 2,417,013 (1947), shows a toggle actuated sliding jaw wrench of parallel jaws. This invention uses a cut out from the handle to provide a slot for a slide bar to carry the moving jaw towards the fixed jaw. However, in order to have a reasonable width of the handle, this arrangement can only provide a limited length of travel slot for the slide bar and may not provide sufficient structural rigidity to maintain the parallelism of the two jaws during the clamping action. Furthermore, the slide bar is sandwiched between two triangular plates. These triangular plates are toggle components and are pivotally connected to the slide bar, which has a slot for the pivotal pin to travel inside during the size adjustment of the workpiece. Eventually this pivotal pin is used to force against the slot to generate the gripping/clamping action. As a result, the pivotal pin and the slot have line stress contact that develops high contact stress level during the gripping/clamping process, and the tool life will be shortened eventually. In addition, the slide bar that carries the sliding jaw rides upon and along the edge of the laterally extended handle wall. Such arrangement is likely to generate side play and does not provide a positively secured moving jaw during a forceful maneuver.

Petersen, in U.S. Pat. No. 2,481,866 (1949), shows a parallel-jaws, lever and rack actuated wrench. The drawback of this invention is due to the requirement of the gear teeth interface. This requirement can cause high production cost. In addition, for a given working range between the two parallel jaws, the pitch circle of the gear may require a relatively long radius to render the toggle clamping mechanism to function properly. This could result a total length of the wrench from being practical.

Boyer, in U.S. Pat. No. 2,519,630 (1950), shows a parallel jaws plier wrench. It has a fixed jaw and a moving jaw, which is pivotally connected to the locking lever and a short bar that is pivotally connected to the handle. When a gripping force is applied to the locking lever toward the handle, the moving jaw will be swung according to the swinging motion of the short bar. The moving jaw has a straight slot following a fixed guiding pin at the handle. Hopefully, according to such an embodiment the swinging movement of the short bar coupled with the guiding motion from the straight slot would render the moving jaw to generate a parallel coaction with the fixed jaw. Unfortunately, the inventor failed to notice that in order to obtain the intended result, the slot, instead of being straight, has to be circularly curve to compensate the swinging movement of the short bar. This invention has another drawback. When a force is applied to the locking lever to clamp a workpiece, this applied force, the toggle force, will push the moving jaw to generate a tendency to rotate clockwise relative to the workpiece. And such tendency might defeat the parallelism of the two jaws.

Blair, in U.S. Pat. No. 2,553,400 (1951), shows a plier-type toggle actuated wrench that have approximate parallel jaws (both jaws rely on pivotal swinging movements). While this approximate parallelism for the two jaws may be acceptable for certain practical purposes, the two jaws, however, cannot close entirely and hence this invention is not very practical. It has a minimum jaw distance that will render the invention inapplicable when the work size is equal to or smaller than the minimum distance between the two jaws. Let alone the clamping of a piece of thin sheet metal. In addition, the ratchet teeth and the required ratchet geometry profiles, if not impossible, are not easy or expensive to produce.

Hudson, in U.S. Pat. No. 4,094,215 (1978), shows a plier wrench of parallel jaws with the moving jaw being carried by a rack. The rack is slidable in a transverse groove and keeps the moving jaw substantially parallel with the fixed jaw. It also has teeth being engaged by a gear for movement control. The gear teeth partially protrude beyond the wrench main handle so that the operating hand can use the thumb to rotate the gear and control the motion of the moving jaw. There is a tab engaging the gear teeth and being controlled by a pivoted moving handle to assert pressure onto the moving jaw via the gear. The tab is designed to have a protruded portion beyond the main handle and the moving handle for the thump to press on when releasing the workpiece is required. The inventor claimed that this arrangement provides an easy release mechanism for a tightly clamped workpiece. However, it appears quite questionable that a single thumb action to press onto a tab having practically no mechanical leverage could release a tightly clamped workpiece.

As are shown by the aforementioned prior-arts of parallel-jaws wrench/plier, the methods being employed to achieve such embodiment have some inherent drawbacks. It would be most desirable to have a wrench/plier which has most of these shortcomings eliminated.

SUMMARY

The current invention has several improvements for the toggle-locking type hand tool, and they can be delineated in the following description. It belongs to the category of parallel jaws wrench/pliers. It has a fixed jaw being outstanding from one end of a tool body element and has a moving jaw being outstanding from a slide bar (guide bar) which is slidable in a channel inside said tool body. The two parallel jaws coact with each other substantially. An action cam having a first corner portion being pivotally supported inside a void in said tool body has a second one corner portion being pivotally connected to said slide bar by an interface which converts rocking movement into rectilinear translation that guides the moving jaw to coact with the fixed jaw substantially. A third corner portion of the action cam is pivotally connected to an upper pivotal hole of a locking lever, which has a lower pivotal hole connecting to the respective upper ends of a fulcrum bar and a releasing lever simultaneously thereof.

A handle formed with hollow cross section is securely attached to said body element and has an end which is formed to accept an axially adjustable element. Said axially adjustable element has an engaging upper tip and said fulcrum bar has an engaging lower end, and they are kept constantly engaged by means of a tension spring latching between said action cam and said handle. A guiding slot is formed machined at the lower portion of said handle to prevent against the side movement of said fulcrum bar during operation.

The locking lever, the fulcrum bar, and the axially adjustable element constitute the basic toggle linkage, i.e., varying the axially adjustable element will directly vary the distance between the jaws to adopt the size of the workpiece. Close to the pivot of said releasing lever, there are two outstanding members disposed to respective opposite side walls thereof. When said pivot is forced by the locking lever to cross the toggle power line for a given work piece, this forward movement is stopped when said outstanding members hit the two respective edges of said handle, and the gripping/clamping action will stay locked.

When the releasing lever is gripped towards the handle, said two outstanding members will act as fulcrums to provide the releasing lever with leverage to force said pivot of the releasing lever to cross the toggle power line backward to its original relaxing condition, and the workpiece is released. This workpiece releasing can be performed with single hand.

DRAWINGS

Figures

FIG. 1 is an isometric view of the wrench/plier. It shows the embodiment in the close jaw position.

FIG. 4-A shows isometric views of all the parts of the embodiment. To avoid crowded labeling situation, only the parts are labeled in this drawing.

FIG. 4-B shows isometric views of all the parts of the embodiment. To avoid crowded labeling situation, only the fasteners and their corresponding holes are labeled in this drawing.

FIG. 4-C shows isometric views of all the parts of the embodiment. To avoid crowded labeling situation, only the pivotal pins and their corresponding holes are labeled in this drawing.

Figure 5:
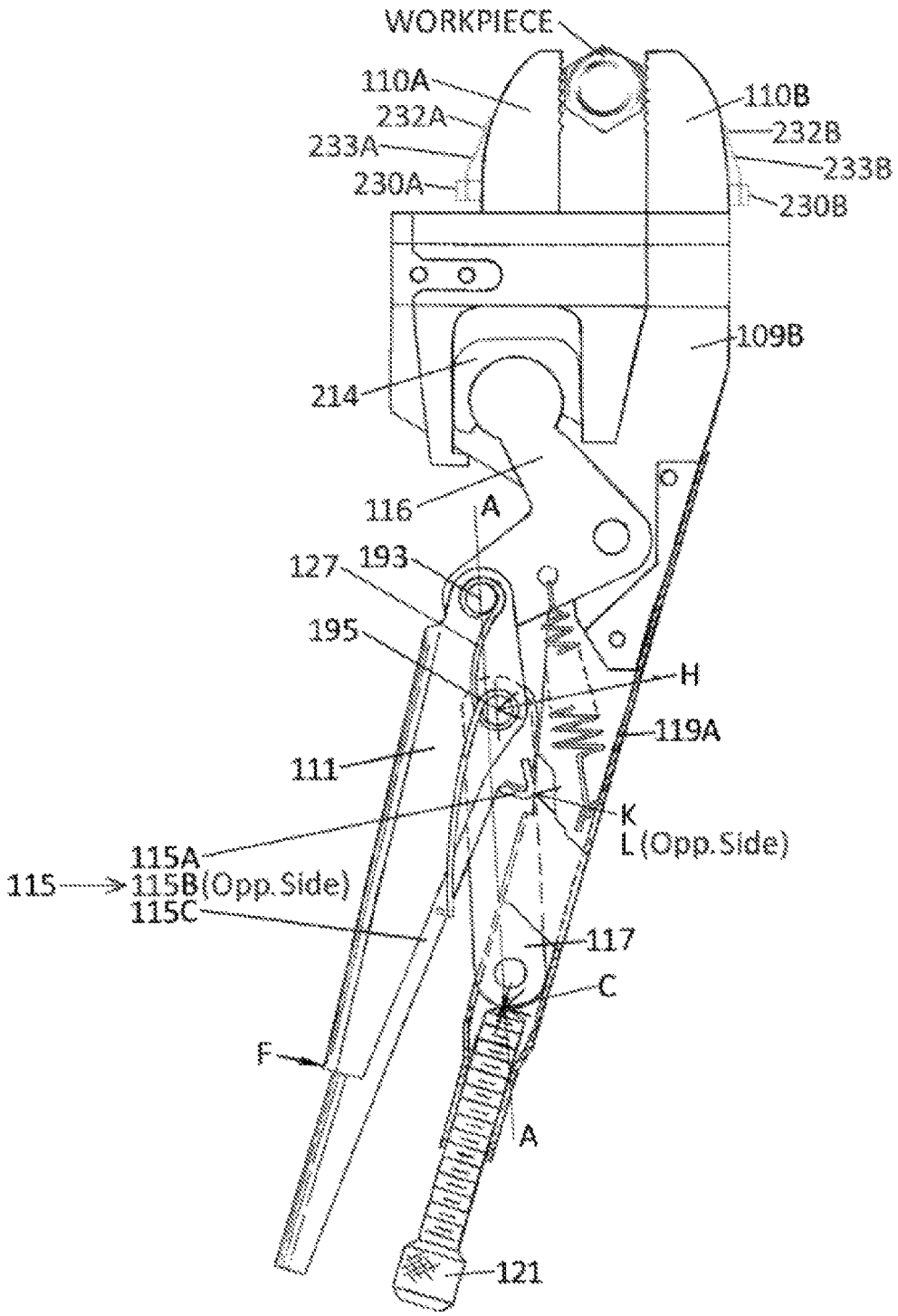

FIG. 5 is an exploded view of the embodiment in the locked configuration of gripping/clamping a workpiece.

Figure 6:
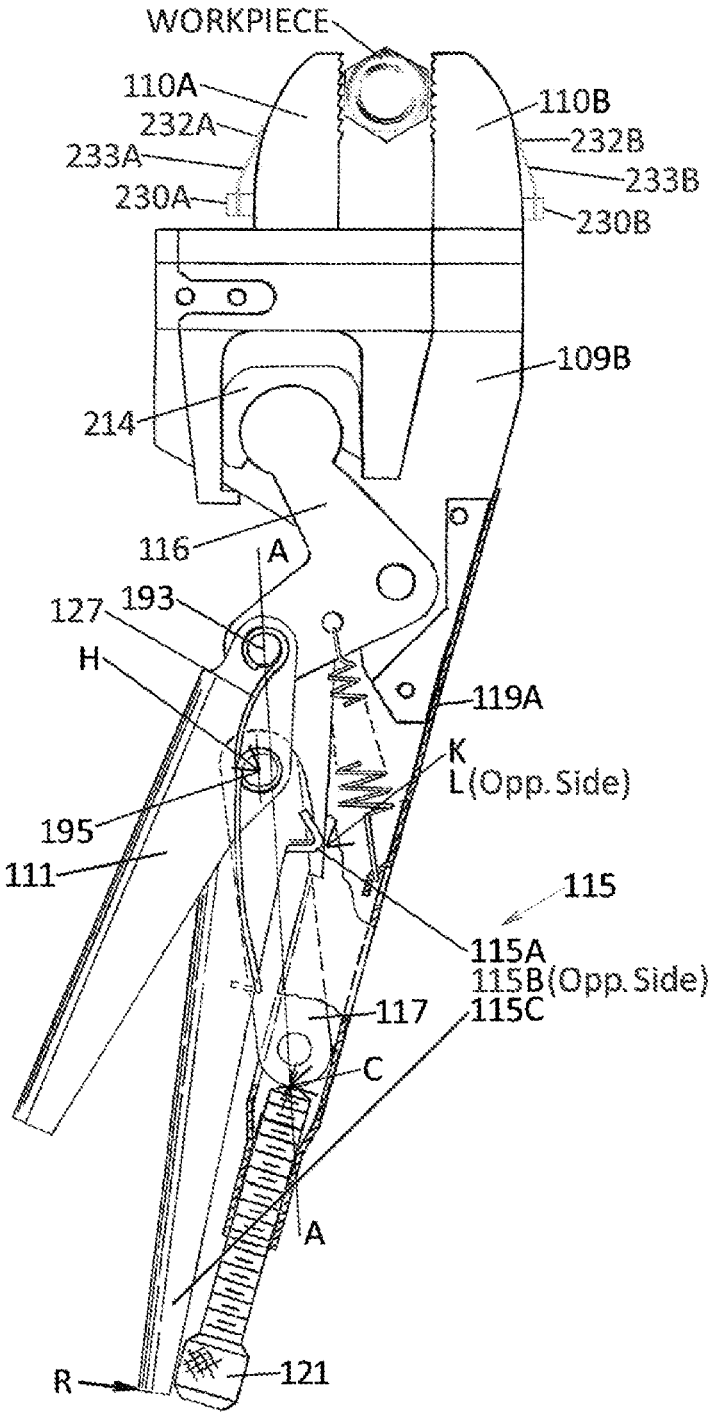
Figure 8:
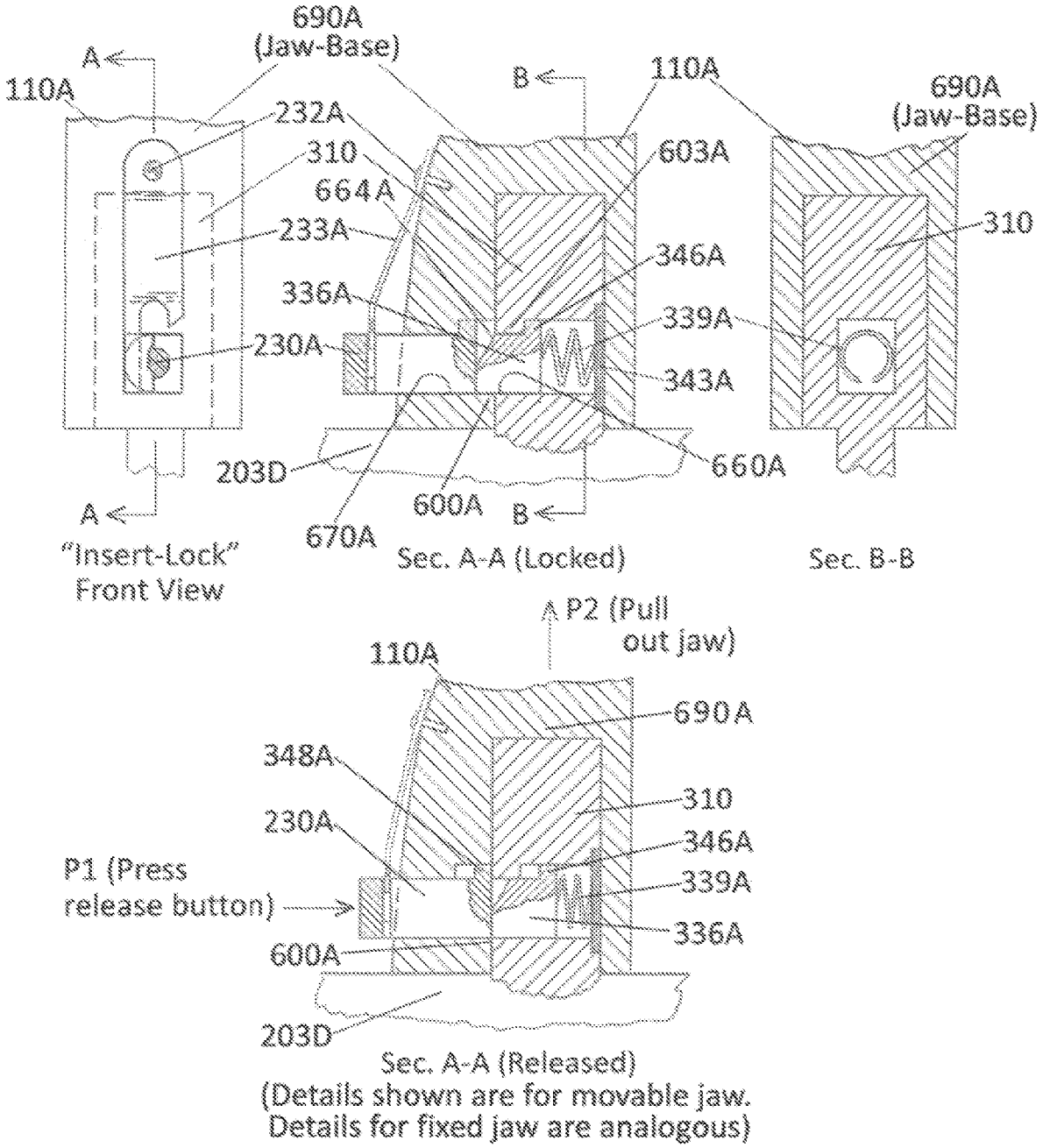
Figure 10:
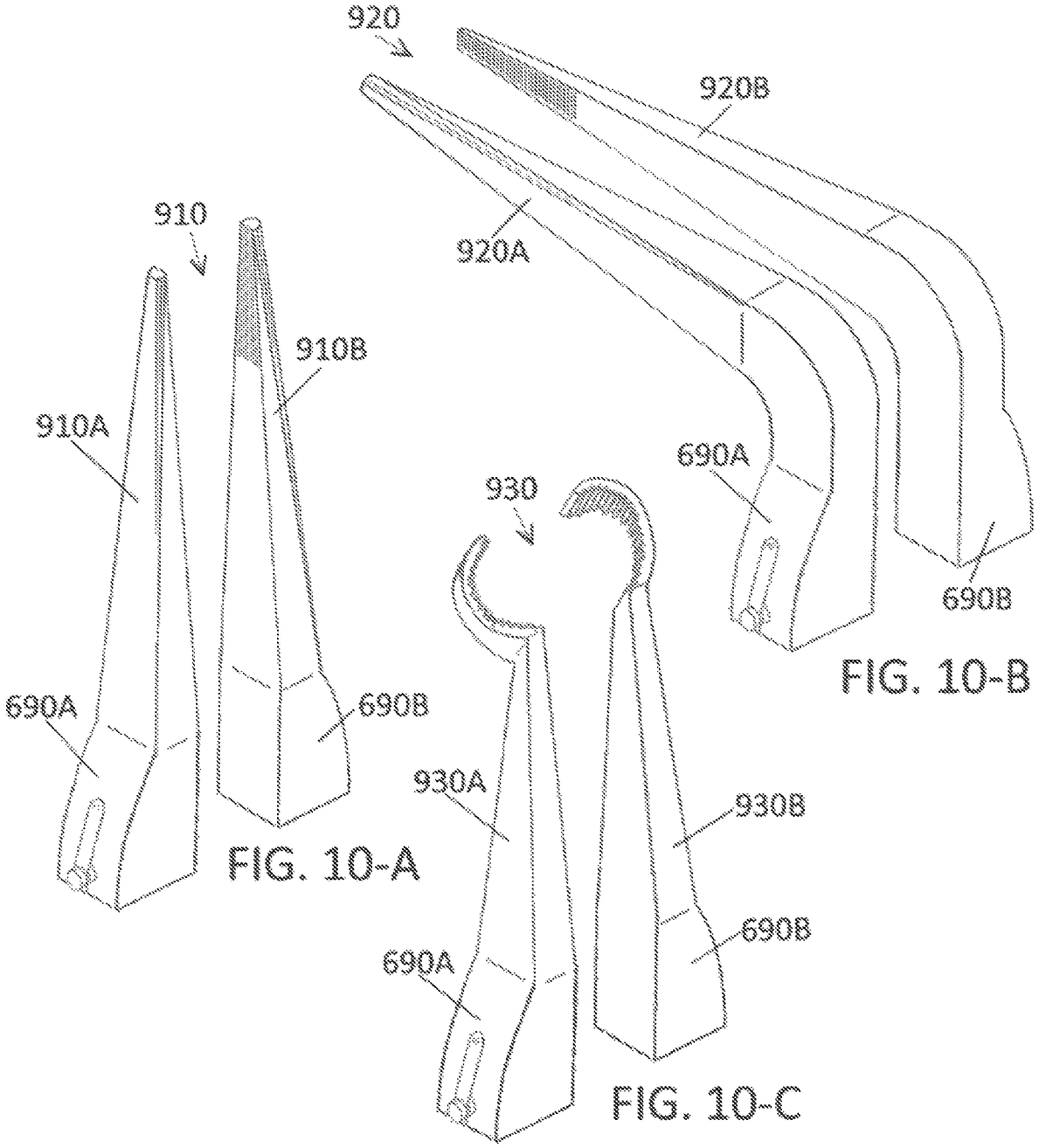

FIG. 6 is an exploded view of the embodiment in the unlocked configuration of releasing a workpiece.

FIG. 7 is a picture of the prototype of the embodiment, which is capable of demonstrating its functionality.

DETAILED DESCRIPTION

According to the comparison of hand tools on parallel jaws locking wrench/plier shown in prior-art publications and on the markets, varieties of embodiments have illustrated different types of construction used to achieve the parallel-jaws configuration. And it is obvious that there should be some embodiments to provide a hand tool with parallel jaws that have consistent jaw tips alignment and are sturdier than prior-art hand tools. Also there should be some embodiments to provide a hand tool that is relatively less expensive but provide good performance better than prior-art or existing parallel jaws hand tools. These and other advantages of one or more features will become obvious from the understanding of the following descriptions and accompanying drawings.

For clarity of illustration, the part numbers are shown in FIG. 4-A, the fastener numbers in FIG. 4-B, the pivotal pin numbers in FIG. 4-C, and element contact point labels in FIGS. 5 and 6.

This embodiment is a hand tool that functions as a vise-grip wrench/plier. The gripping or clamping function, as it may be called, is performed by a serrated fixed jaw 110 and a serrated moving jaw 203D, as shown by FIG. 1. These two jaws always maintain parallelism to each other within the working range to provide a tight surface contact to a workpiece that has parallel opposite faces, e.g., a screw nut. The serrated fixed jaw 110 is composed of a thin fixed jaw 110A, a thick fixed jaw 110B, and a serrated plate 110C, as shown by FIG. 1.

The serrated plate 110C is welded to the thin fixed jaw 110A and the thick fixed jaw 110B after the embodiment is assembled. The serrated moving jaw 203D is part of a guide bar 203C, as shown by FIG. 4-A. The member 203 is formed by machining a piece of forged steel into the serrated moving jaw 203D, the guide bar 203C. The right tapered bar 203A and the left tapered bar 203B are the results from forging. Only their inside opposing edges are machined substantially parallel with respect to each other.

Figure 2:
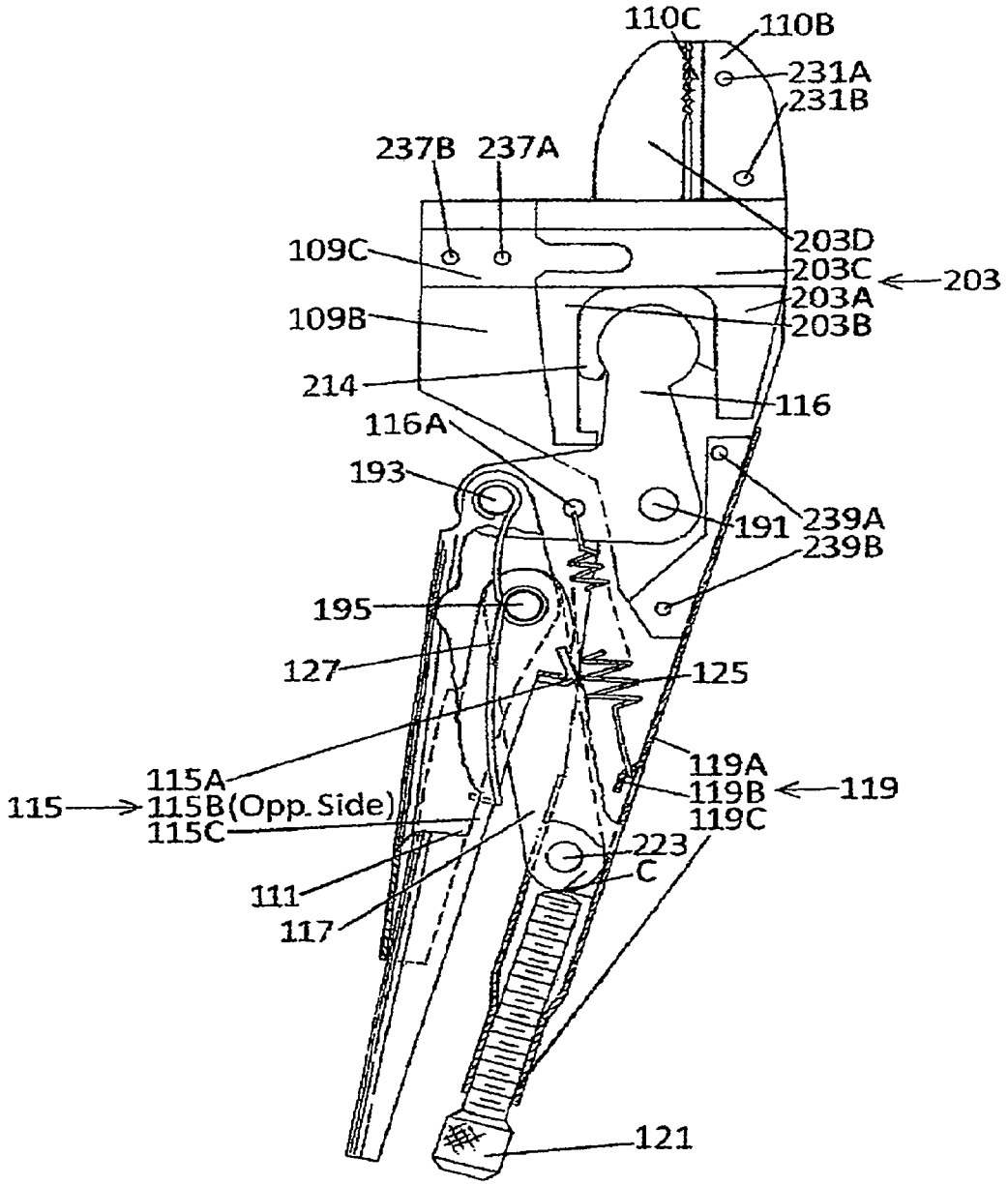
FIG. 2 is an exploded view of the embodiment in the close jaw position.
Figure 3:
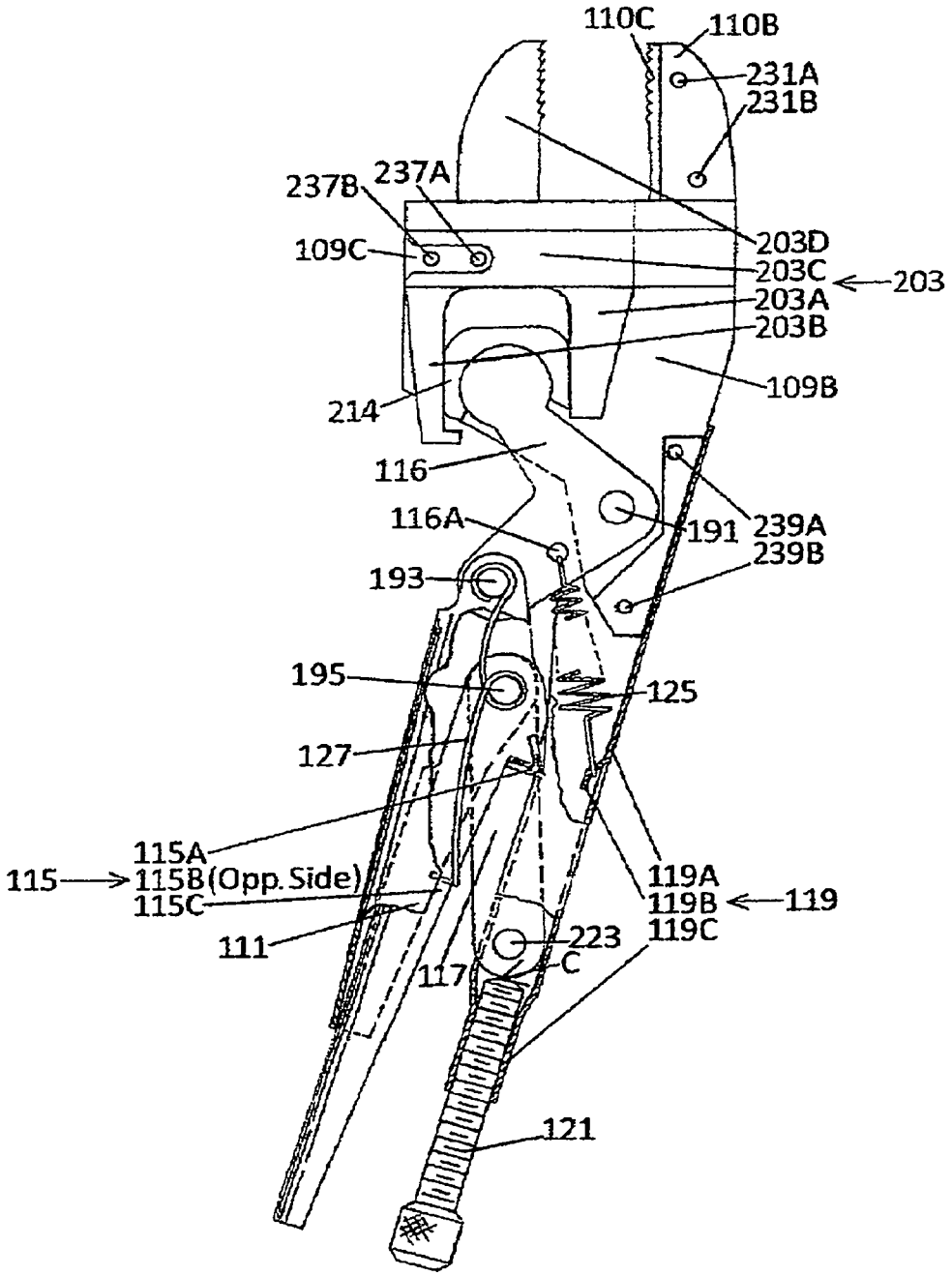
FIG. 3 is an exploded view of the embodiment in the open jaw position.

FIGS. 2 and 3 illustrate the rectilinear sliding motion of the moving jaw 203D, which is imposed by the rocking movement of an action cam 116 through an interface 214 that slides between the inside parallel opposing edges of the right tapered bar 203A and the left tapered bar 203B. The interface 214 is needed as explained in the next paragraph. Both the interface 214 and the action cam 116 can be made by stamping out from steel plate before heat treatment.

The pivotal connection of the second corner portion of said action cam to the interface comprises an inner circular opening in said interface and a corresponding outside circular profile around said second corner portion of said action cam to rotatably engage the action cam relative to the interface, thereby defining said pivotal connection between said second corner portion and said interface. The clamping action is generated when the action cam 116 is pressing the right tapered bar 203A via the interface 214. If the interface 214 is not employed, the contact between the action cam 116 and the right tapered bar 203A will be a line contact that generates large contact stress which will shorten the life of the tool, because the action cam 116 has a circular surface contact geometry, whereas the right tapered bar 203A has a straight plane The movement of the moving jaw 203D is guided by the guide bar 203C, which is sandwiched between a channel 109C and a channel 109D, as shown by FIG. 4-A.

The complete wrench/plier body (body element) is composed of two body matching parts, namely, a body matching part 109A (thin fixed jaw side) and a body matching part 109B (thick fixed jaw side), as shown by FIG. 1. Both of the two parts are made by first forging two steel plates and then machining them to the configurations shown by FIG. 4-A. They are configured to house the parts 203A to 203C, the interface 214, and the action cam 116 when they are assembled and secured by binders 151A, 151B, 153A, 153B, 155A and 155B, as shown by FIG. 4-B. A channel (defined by channels 109C and 109D) is disposed between the two body matching parts, across the body element, and under the fixed jaw. The void is disposed between the two body matching parts under and communicating with said channel.

As shown by the exploded views FIGS. 2 and 3, the action cam 116 is pivoted inside the body housing described above by means of a pivotal hinge pin 191. It is also pivotally connected to a locking lever 111 by means of a hinge pin 193. The locking lever 111 is also pivotally connected to a fulcrum bar 117 by means of a hinge pin 195. The fulcrum bar 117 is partially concealed inside the wrench/plier handle 119A and is constantly engaged with an axially adjustable element 121 at the contact location C, as illustrated by FIGS. 2 and 3.

The handle 119A is formed with a piece of sheet metal into a channel cross-section for strength. The end of the handle 119A is formed into a tube 119C, which has internal threats to accept the element 121. A guiding slot 129, shown by FIG. 1, is machined to allow the fulcrum bar 117 to travel according to the adjustment of the element 121, as shown by FIG. 4-A.

The tension spring 125 is used to keep the fulcrum bar 117 consistently engaging with the upper tip of the element 121 at location C. This arrangement constrains the moving jaw 203D to travel consistently according to the adjustment of the element 121.

A spring wire 127 of the releasing lever 115C is used to keep the releasing lever 115C to always remain within the locking lever 111 to avoid the undesirable swinging movement of the latter during the usage of the tool.

As shown by FIG. 4-A, the releasing lever 115C has two outstanding members 115A and 115B formed at the two opposite sides, respectively. Their functions are explained in detail in the OPERATION section.

The parallel plier jaws currently shown are used for illustration only. They can be configured to many different forms to suit the requirements for various workpieces, e.g., pointed nose pliers, curved serrated jaws for round workpieces, just to name a few.

REFERENCE NUMERALS (Refer to FIG. 4-A)

109 group number for the channel group 109A, 109B, 109C, and 109D
109A body matching part (thin fixed jaw side)
109B body matching part (thick fixed jaw side)
109C channel wall (thick fixed jaw side)
109D channel wall (thin fixed jaw side)
110 group number for the serrated fixed jaw group of 110A, 110B, and 110C
110A thin fixed jaw
110B thick fixed jaw
110C serrated plate
111 locking lever
113A spacer (near side)
113B spacer (far side)
115 group number for the releasing lever group 115A, 115B, and 115C
115A outstanding member (far side)
115B outstanding member (near side)
115C releasing lever
116 action cam
116A tension spring anchoring hole
117 fulcrum bar
117A fulcrum bar stopper hole
119 group number for the handle group of 119A, 119B, and 119C
119A handle
119B tension spring anchor
119C end of handle
121 axially adjustable element
125 tension spring
127 spring wire of releasing lever
129 guiding slot
203 group number for the serrated moving jaw group of 203A, 203B, 203C, and 203D
203A right tapered bar
203B left tapered bar
203C guide bar
203D serrated moving jaw
214 interface
223 stopper (Refer to FIG. 4-B)

151A fixed jaw upper fastener
151B fixed jaw lower fastener
153A channel right fastener
153B channel left fastener
155A handle upper fastener
155B handle lower fastener
231A thick fixed jaw upper fastener hole
231B thick fixed jaw lower fastener hole
237A thick fixed jaw channel right fastener hole

237B thick fixed jaw channel left fastener hole
239A thick fixed jaw body matching part upper fastener hole
239B thick fixed jaw body matching part lower fastener hole
433A thin fixed jaw upper fastener hole
433B thin fixed jaw lower fastener hole
435A thin fixed jaw channel right fastener hole
435B thin fixed jaw channel left fastener hole
441A thin fixed jaw body matching part upper fastener hole
441B thin fixed jaw body matching part lower fastener hole
443A handle upper fastener hole (near side)
443B handle lower fastener hole (near side)
445A handle upper fastener hole (far side)
445B handle lower fastener hole (far side)
(Refer to FIG. 4-C)
191 action cam pivotal hinge pin
193 locking lever pivotal hinge pin
195 fulcrum bar pivotal hinge pin
471A handle pivotal hole (near side)
471B handle pivotal hole (far side)
473 body matching part pivotal hole (thin fixed jaw)
475 action cam pivotal hole
477 body matching part pivotal hole (thick fixed jaw)
479 action cam-to-locking lever pivotal hole
480A spacer pivotal hole (near side)
480B spacer pivotal hole (far side)
481A locking lever upper pivotal hole (near side)
481B locking lever upper pivotal hole (far side)
483A locking lever lower pivotal hole (near side)
483B locking lever lower pivotal hole (far side)
485A releasing lever pivotal hole (near side)
485B releasing lever pivotal hole (far side)
487 fulcrum bar pivotal hole
(Refer to FIG. 5 and FIG. 6)
C contact point between lower end of fulcrum bar and upper tip of adjustable element
H center of fulcrum bar pivotal hinge
K contact point between outstanding member and handle
L contact point between outstanding member and handle (Opp. Side)

Operation

For the current embodiment (refer to FIGS. 2 and 3), the open-jaw distance required for the size of a workpiece is achieved by adjusting an axially adjustable element 121. The adjustment causes a rocking motion on an action cam 116 through the connection of a locking lever 111 by means of pivotal hinge pins 193 and 195, which connects to a fulcrum bar 117. The lower end of said bar 117 has constant engagement with the upper tip of said element 121. By means of the configuration of an interface 214 and its movement between the opposing parallel edges of a right tapered bar 203A and a left tapered bar 203B, the rocking motion of said cam 116 imposes a rectilinear movement on a guide bar 203C sliding in a channel 109 to carry a moving jaw 203D to press the workpiece against the fixed jaw 110.

When a gripping force F is applied to the locking lever 111 towards the handle 119A, as shown by FIG. 5, a clamping force on the workpiece is generated when the center H of pivotal connection pin 195 of bar 117 is pushed to the position of the power line A-A (shown by FIG. 5 as a straight line defined from the center of hinge pin 193 to the engaging point C of said bar 117 and said element 121. The line A-A is termed power line because the workpiece will experience maximum clamping/gripping force when the center point H of said hinge pin 195 is at this line. If said applied force F pushes the center point H further to pass the power line A-A, said point H will be stopped when two outstanding members 115A and 115B touch the respective edges of the handle 119A at point K and point L (opp. side), as shown by FIG. 5. At this configuration of the embodiment, the tight clamping/gripping onto the workpiece is achieved and is securely locked without requiring any further hand gripping assistance from the hand.

When the workpiece is to be released, the user can apply a force R to the releasing lever 115C towards the handle 119A, as shown by FIG. 6. The two members 115A and 115B now together act as a fulcrum to provide leverage to the releasing lever 115C, and the center point H will be pushed to cross the power line A-A back to its originally unclamp position, and the clamping action on the workpiece is thus entirely released. The release of the workpiece can be performed single handedly with the gripping force R applied towards the handle 119A.

Other embodiments for different kinds of jaw configurations applying to different workpiece requirements will operate in a similar manner.

CONCLUSION

According to the foregoing detailed description, it can be seen that the current parallel-j aws locking wrench/plier will provide a reliable and useful hand tool with strong gripping/clamping force from a pair of sturdy parallel jaws, which have minimum side play and consistent-inline jaw tips within the working range. In addition, the subject invention provides the user with an easy effort to release a tightly gripped/clamped workpiece with single hand, due to the large leverage ratio provided by the releasing lever.

To produce this hand tool, conventional manufacturing methods can be employed. Tool steel alloys with additives such as vanadium or chromium can be used for the two body matching parts, which contain the thick and the thin fixed jaw parts, respectively. Simple forging and machining procedures can be used. As for the interface, the action cam, and the fulcrum bar, stamping on medium gauge tool steel sheet metal material can be done conveniently, since their geometric profiles are very simple. Finally, the handle, the locking lever, and the releasing lever can be conveniently formed with thinner gauge tool steel sheet material. Overall, the production process can be reasonably conventional and economical.

A prototype is available to prove functionality and the ability of the embodiment. It has an one-inch wide workpiece capacity.

The parallel plier jaws currently shown are used for illustration only. They can be configured to many different forms to suit the requirements for various geometries of the workpieces, e.g., pointed nose pliers, curved serrated jaws for round workpieces, just to name a few.

I claim:

1. A parallel jaws locking wrench/pliers with toggle action, comprising:

a body element comprising two body matching parts connected to each other, a fixed jaw being disposed at an upper corner of the body element, a channel disposed between the two body matching parts, across the body element, and under the fixed jaw, a void disposed between the two body matching parts under and communicating with said channel, a plate comprising one face which is serrated and an opposing face which is smooth, the opposing face affixed to the fixed jaw, a guide bar that is slidable along said channel, the guide bar carrying a serrated moving jaw to coact with said fixed jaw, two tapered bars comprising a left tapered bar and a right tapered bar, the tapered bars extending downward from opposing ends of the guide slide bar into said void, opposing edges of the two tapered bars being straight and parallel to each other with an interface being slidably disposed therebetween, an action cam having a first corner portion being pivotally supported inside said void, a second corner portion pivotally connected to said interface, and a third corner portion pivotally connected to an upper pivotal hole of a locking lever, a handle defining a channel cross section, the handle attached to said body element, and an end of the handle defining internal threads to accept an axially adjustable element, a fulcrum bar having a lower end engaged with an upper end of said axially adjustable element by a tension spring connected between said action cam and said handle, a releasing lever comprising a pivot, by which the releasing lever is pivotally connected to a lower pivot of said locking lever and connected to a pivot of an upper end of said fulcrum bar, a length of spring wire having an upper end that is connected to the locking lever, and a lower end that is connected to the releasing lever to prevent the releasing lever from unintentionally swinging out of the locking lever during operation, and wherein said handle has a guiding slot at a lower portion of the handle to guide the fulcrum bar during operation, the end of the fulcrum bar defines a stopper hole which receives a rod to act as a stopper to prevent fall-out of the fulcrum bar, wherein the locking wrench/pliers is configured to minimize side play of both jaws, thereby providing consistent alignment of both jaws relative to each other.

2. The parallel jaws locking wrench/pliers as set forth in claim 1, wherein said pivotal connection of the second corner portion of said action cam to said interface comprises an inner circular opening in said interface and a corresponding outside circular profile around said second corner portion of said action cam to rotatably engage the action cam relative to the interface, thereby defining said pivotal connection between said second corner portion and said interface.

* * * * *